United States Patent [19]

Stoudt

[11] Patent Number: 4,472,047

[45] Date of Patent: Sep. 18, 1984

[54] APPARATUS AND METHOD FOR ELECTROPHOTOGRAPHICALLY PRODUCING COPY HAVING CONTINUOUS-TONE AND OTHER CONTENT

[75] Inventor: Michael D. Stoudt, Webster, N.Y.

[73] Assignee: Eastman Kodak Company, Rochester, N.Y.

[21] Appl. No.: 493,868

[22] Filed: May 12, 1983

[51] Int. Cl.[3] ..... G03G 15/01

[52] U.S. Cl. ..... 355/4; 355/11; 355/77; 430/54

[58] Field of Search ..... 355/3 R, 4, 11, 14 E, 355/67, 69, 70, 71, 75, 76, 77; 430/31, 42, 44, 54

[56] References Cited

U.S. PATENT DOCUMENTS

| | | | |
|---|---|---|---|
| 3,439,983 | 4/1969 | Blow, Jr. | 355/11 X |
| 3,523,725 | 8/1968 | Schaeffer | 355/8 |
| 3,576,367 | 4/1971 | Sable | 355/6 |
| 3,615,392 | 10/1971 | Honjo | 96/1.2 |
| 3,620,618 | 11/1971 | White | 355/6 |
| 3,724,943 | 4/1973 | Draugelis et al. | 355/4 |
| 3,728,018 | 4/1973 | Wharton et al. | 355/46 |
| 3,825,338 | 7/1974 | Kolibas | 355/50 |
| 3,970,042 | 7/1976 | Rees | 118/637 |
| 4,027,962 | 6/1977 | Mailloux | 355/4 |
| 4,043,656 | 8/1977 | Cherian | 355/3 R |
| 4,111,542 | 9/1978 | Mailloux et al. | 355/14 |
| 4,256,820 | 3/1981 | Landa | 355/3 R X |

*Primary Examiner*—John Gonzales
*Assistant Examiner*—J. Pendegrass
*Attorney, Agent, or Firm*—John D. Husser

[57] ABSTRACT

Method and apparatus for electrophotographically producing high quality reproductions which contain different content types. Photoconductor image sectors are subjected to separate, component exposures selected for (1) good tone-scale reproduction of continuous-tone image portions and (2) high-contrast reproduction of line-type image portions. Photoconductor background areas, which border continuous-tone image portions, are exposed to a discharge level below the system's development level.

21 Claims, 4 Drawing Figures

APPARATUS AND METHOD FOR ELECTROPHOTOGRAPHICALLY PRODUCING COPY HAVING CONTINUOUS-TONE AND OTHER CONTENT

BACKGROUND OF THE INVENTION

1. Field of the Invention

The present invention relates to electrophotographic reproduction methods and apparatus and more specifically to the improved production of copy (including black-and-white and color reproductions) of the kind having both continuous-tone (e.g. pictorial) and other (e.g. uniform background and/or line-type) content.

2. Brief Description of the Prior Art

As the development and use of electrophotography continues to advance, one continuing goal is to improve the quality of electrophotographic reproductions which contain different types of information content such as continuous-tone content, line-type content and uniform background content. Various problems make attainment of this goal a technical challenge. For example, procedures which tend to optimize reproduction of line-type information (for example alphanumerics, line drawings, graphs, etc.) are not optimal for reproduction of continuous-tone information (for example photographs, paintings, etc). The problems only worsen when it is desired to make such high quality reproductions in automated equipment that is capable of continuous mode operation and good productivity. The accommodation of color information, as well as black-and-white information, poses even further problems.

A wide variety of electrophotographic techniques and equipment approaches have been suggested to meet one or more of the problems outlined above; however, there is considerable desire for further improvement.

SUMMARY OF THE INVENTION

One important purpose of the present invention is to provide improved apparatus and techniques for coping with the problems, such as outlined above, that arise in electrophotographically producing high quality reproductions containing such different types of information content. A variety of advantages pertain to the different aspects of the invention, which are described in more detail below. For example, significant advantages exist in regard to the flexibility, simplicity and speed with which high quality reproductions can be produced in accord with the present invention.

In one aspect the present invention provides a method of producing an electrophotographic image having a continuous-tone information area and substantially clean adjacent background area. This method involves primary-charging a photoconductor image sector; reflection exposing the charged photoconductor sector, at a first exposure level, to an original having a light-reflective, continuous-tone information area and an adjacent background area which is substantially transparent; in register, transmission exposing the photoconductor sector to the original at a second exposure level which discharges the background area below the development level; and developing the composite latent electrostatic image formed by such reflection and transmission exposures.

In another aspect the present invention provides a method of producing an electrophotographic composite image having continuous-tone information areas and high-contrast, line-type information areas. This method involves primary-charging a photoconductor sector of size which accommodates the composite image to be reproduced; reflection exposing the sector, at a first exposure level and through a half-tone screen, to a first original component which comprises a light-reflective, continuous-tone information area and a non-reflective area; exposing the photoconductor at a second exposure level to a second original component which comprises a mask-area located in register with the continuous-tone information area of the first original component and a high-contrast, line-type information area at a location not in register with that continuous-tone area; and developing the composite latent electrostatic image formed on the photoconductor sector.

In another aspect the present invention provides a method of producing a composite electrophotographic image having a continuous-tone, multicolor information area, a substantially clean background area and a high-contrast, line-type information area. This method involves primary-charging first, second, third and fourth photoconductor image sectors; reflection exposing three of said sectors, respectively via different color filters, through a half-tone screen and at a first exposure level adapted for tone-scale reproduction to a first original component which comprises a light-reflective, continuous-tone, color information area and a light-transmissive background area; and in register, transmission exposing those three sectors at a second exposure level which discharges the respective background photoconductor portions below development level. The other of the sectors is reflection exposed to the first original component through the half-tone screen, and exposed without a screen, at an exposure level adapted for line-type reproduction, to a second original component which has: (1) mask-areas located in register with the continuous-tone areas of the first original component and (2) high-contrast, line-type information areas at locations not in register with those continuous-tone areas. The three sectors are developed respectively with different-color toners corresponding to their respective color filter exposure and the other sector is developed with black toner. Finally the developed toner images are transferred from respective photoconductor sectors in register onto a copy sheet.

In further aspects the present invention provides structural configurations for producing electrophotographic images according to the above-described and equivalent methods in a highly productive continuous mode of operation.

BRIEF DESCRIPTION OF THE DRAWINGS

The subsequent description of preferred embodiments of the present invention refers to the attached drawings wherein.

DETAILED DESCRIPTION OF THE PREFERRED EMBODIMENTS

Figure 1:
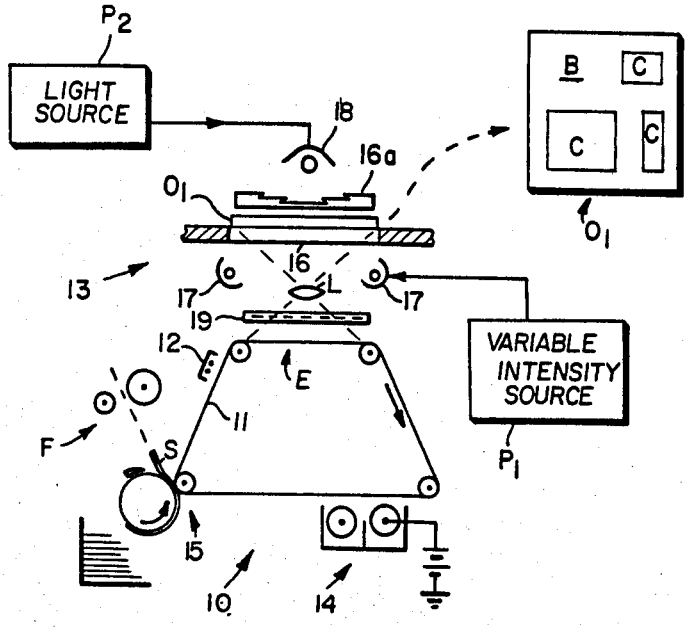
FIG. 1 is a schematic side view of one embodiment of electrophotographic apparatus for practice of the present invention.

Referring now to FIG. 1, there is shown an apparatus 10 which is adapted, in accord with one aspect of the present invention, to produce electrophotographic reproductions of documents including continuous-tone image areas and surrounding white (or low-density) background border zones. One advantageous feature of the FIG. 1 structure and technique is its capability to produce good tone-scale (particularly in difficult highlight portions) together with backgrounds which are "substantially clean" (i.e. do not have an objectionable density level). The apparatus 10 includes a photoconductor 11 (e.g. a belt comprising a photoconductive insulator layer overlying a conductive layer on a support) having one or more image sectors adapted for movement along an operative path past primary charging station 12, exposure station 13, development station 14 and transfer station 15. The corona charger at station 12, magnetic brushes at station 14 and transfer roller at station 15 can be of the various types known in the art and equivalent devices can be utilized. The inventive structural and procedural aspects of the FIG. 1 embodiment of the invention pertain to exposure station 13.

The exposure procedure and structure of the present invention involve provision and use of an original of predetermined format. Specifically, the original $O_1$ comprises a light reflective continuous-tone area(s) C formed within a light-transmissive background area B. One preferred embodiment comprises photographic prints mounted on a light-transmissive plastic support. In accord with the present invention the exposure station 13 includes means for supporting original $O_1$ (e.g. transparent platen 16) at the illumination zone of apparatus 10, a first illumination source 17 located between the illumination zone and the photoconductor 11 and second illumination source 18 located on the opposite side of the illumination zone from photoconductor 11. Lens means L is provided to image the original at the illumination zone onto the photoconductor 11 at exposure zone E and a Fresnel-type field lens element **16*a* images the transmission source 18 on the lens L. (If the background area B is diffuse, lens 16*a* can be omitted; however, the source 18 should be of a higher intensity.) A particularly preferred embodiment includes a half-tone screen 19** located in the optical path of lens L and proximate the exposure zone.

In operation, a photoconductor image sector is moved past the charging station 12, where it receives a uniform primary electrostatic charge, and into exposure zone E. At this stage illumination sources 17 and 18 are actuated to illuminate the original $O_1$ (which is in place on platen 16 with its light-reflective, continuous-tone portions facing the exposure zone E). More particularly, sources 17, e.g. xenon flash lamps are energized by power source $P_1$ at an intensity level selected for optimizing tone-scale of the electrostatic latent image formed on the photoconductor by light reflected from the continuous-tone portions C. The light source 18, e.g. a xenon flash lamp, is energized by its power source $P_2$ to provide an exposure level at the photoconductor which substantially discharges portions of the photoconductor (corresponding to background B) by transmission exposure. That is, the intensity of this transmission exposure is selected to reduce the electrostatic charge level of portions corresponding to document background below the development level of the apparatus (e.g. to a level proximate or below the bias on magnetic brushes at development station 14). The discharge of transmission-exposed photoconductor portions therefore is preferably more than the maximum discharge (minimum development density level) of the reflection-exposed portions. When screen 19 is present, the exposure from source 18 is selected to discharge the screen pattern in the background areas below the development level of the apparatus. The electrostatic image is then developed at 14, and the resulting toner image is transferred to copy sheet S and fixed at fusing station F. Thus, in accord with the present invention, continuous-tone photoconductor regions can be exposed at one of a plurality of preselectable levels (chosen to optimize tone-scale of the electrostatic image) and such continuous-tone exposure need not be concerned with the need for complete discharge in document background areas. This allows substantial improvement in the quality of electrophotographic reproductions of images which contain different content types like $O_1$.

As will be readily appreciated by those skilled in the art, the level of photoconductor exposure of the continuous-tone images can be varied in ways other than adjustment of the illumination intensity of source $P_1$, e.g. such as by aperture adjustment and/or illumination time control. Similarly one skilled in the art may readily substitute other exposure techniques, e.g. scan exposure techniques, for the flash exposure system described with respect to FIG. 1. In certain applications the portions B of original $O_1$ may desirably be selectively light-transmissive, light diffusive and/or contain opaque line-type information. Also, if desired a graphic transparency image can be overlaid in a desired register with the original $O_1$, e.g. in register with a portion of background B.

Figure 2:
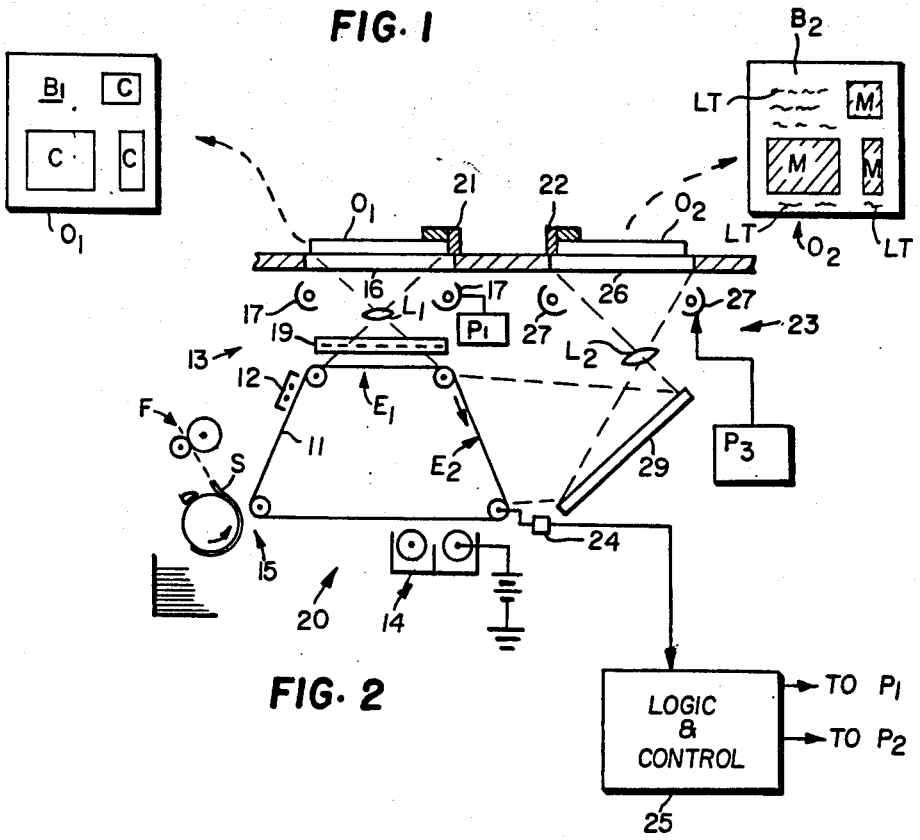
FIG. 2 is a schematic side view of another embodiment of electrophotographic apparatus for practice of the present invention.

Referring now to FIG. 2, the apparatus 20 is adapted, in accord with the present invention, to produce electrophotographic reproductions having screened, continuous-tone image areas of excellent tone-scale, "substantially clean" background areas and unscreened line-type information areas with high contrast. In this embodiment first and second component-originals $O_1$ and $O_2$ are employed to form a composite reproduction. Much of the structure of apparatus 20 can be the same as described with respect to FIG. 1, and such common structure is indicated with corresponding designators in FIG. 2. The additional structure of the apparatus 20 in general comprises a second exposure station 23 constructed to expose a second component original $O_2$ at a second exposure zone $E_2$. Positioning structure 21 and 22 is provided respectively at exposure stations 13 and 23 to accurately locate originals on the exposure platens. A photoconductor location detector 24 and logic and control unit 25 are provided to coordinate exposure of component original $O_2$ in register on a common photoconductor image sector with the electrostatic image of a first component original $O_1$ (previously exposed on that photoconductor sector at station $E_1$). Illumination source 18 of the FIG. 1 embodiment is not employed in the FIG. 2 embodiment.

Station 23 includes a light-transmissive document platen 26, illumination sources 27 (e.g. xenon flash lamps) coupled to a power source $P_3$, mirror 29 and lens means $L_2$ for imaging a component original $O_2$ at exposure zone $E_2$. The component original $O_2$ is predeterminedly constructed to cooperate with original component $O_1$, and for this purpose $O_2$ has mask portions M which prevent source 27 illumination from passing to predetermined portions of exposure zone $E_2$ (viz. those portions which correspond to portions C of the original $O_1$). In embodiments where sources 27 are located to reflectively illuminate component original $O_2$, the portions M can be light-absorptive (e.g. black) or light-transmissive. In such an embodiment, the background portions $B_2$ of component original $O_2$ are desirably highly light-reflective (e.g. white) and line-type portions LT are light-absorptive (e.g. black). If desired the illumination sources 27 can be on the opposite side of platen 26 from exposure zone $E_2$ and in such an embodiment the component original $O_2$ can have light-reflective or opaque mask portions M, light-transmissive background portions $B_2$ and light-blocking line-type portions LT (e.g. black, light-reflective or light-scattering alphanumerics). As will be understood by those skilled in the art, the background portions $B_1$ of component original $O_1$ can be light-absorptive rather than light-transmissive. The desired function is to mask (e.g. be non-reflective to) source 17 light and thus prevent it from passing to the photoconductor sector corresponding to portions B of original $O_1$. A platen cover formed of light-absorptive material also could be used for this purpose.

In operation, a photoconductor image sector is primary-charged at station 12, transported to exposure zone $E_1$ and exposed to component original $O_1$ by sources 17 as previously described with respect to FIG. 1. This provides a screened electrostatic latent image of the desired tone-scale on photoconductor sector portions corresponding to continuous-tone information areas C of component original $O_1$. The uniform primary charge remains on portions of the photoconductor sector that correspond to background portions $B_1$ of original $O_1$. The photoconductor sector next moves to exposure zone $E_2$; and when it is in proper alignment with respect to exposure station 23 (as sensed by detector 24), logic unit 25 effects a high-contrast exposure of that photoconductor image sector to cooperative component original $O_2$. Thus sources 27 are energized and the photoconductor sector is exposed to $O_2$ via lens $L_2$ and mirror 29 at a high exposure level. This forms a high-contrast, non-screened image of line-type information areas LT and, in addition, discharges the photoconductor image sector portions corresponding to background areas $B_2$ (to a level below the development level of apparatus 20). The photoconductor image sector, which now bears the composite electrostatic image, is then developed by magnetic brushes at station 14 and the developed toner image is transferred to a copy sheet S at station 15 and fixed to the sheet at fusing station F.

Figure 3:
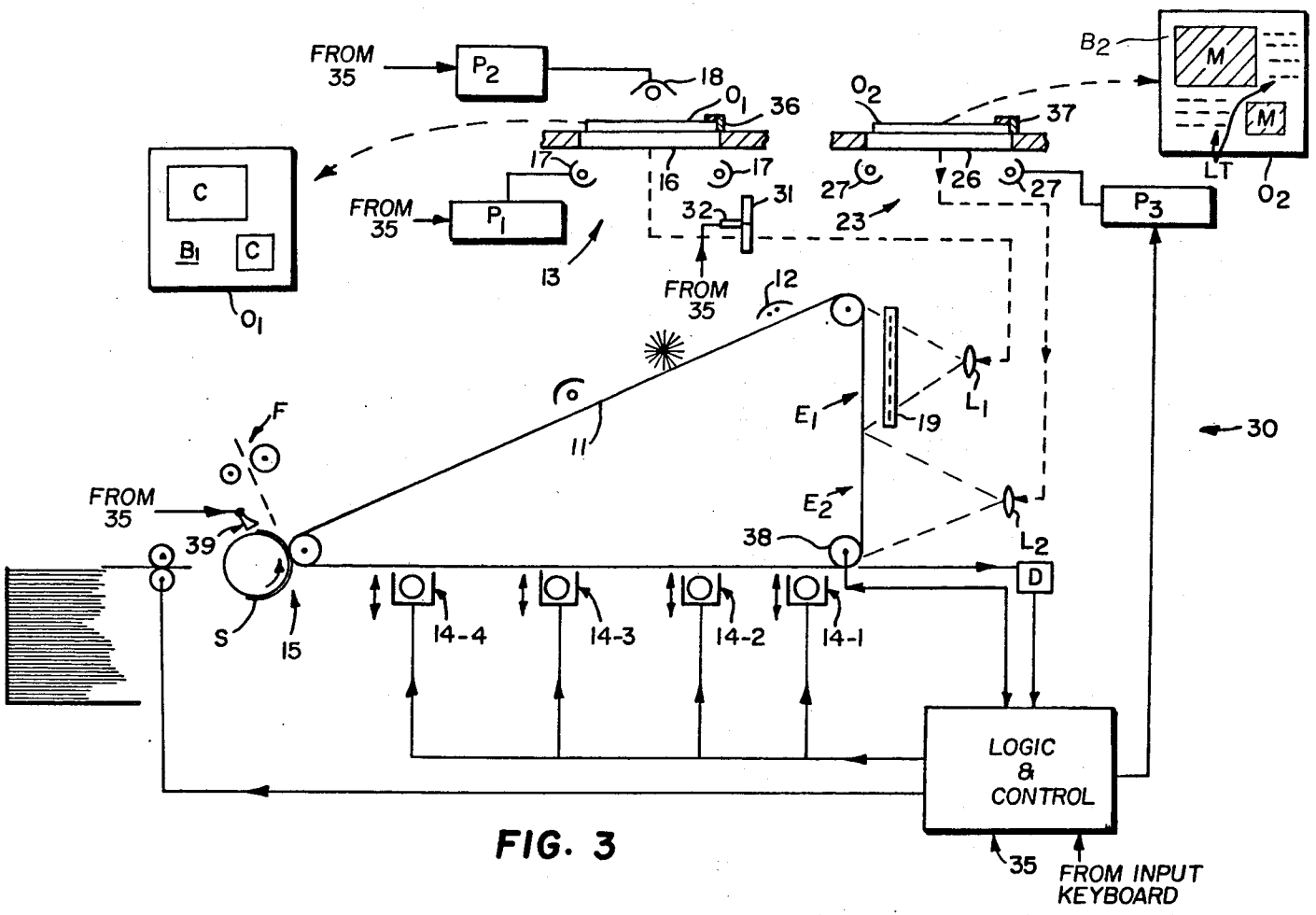
FIG. 3 is a schematic side view of another embodiment of electrophotographic apparatus for practice of the present invention.

Referring now to FIG. 3, apparatus 30 provides features and advantages such as previously described in an embodiment capable of producing color or black-and-white reproductions containing different information content types. The apparatus 30 provides reproductions wherein continuous-tone areas have good tone-scale, line-type information areas are of high contrast and background areas are "substantially clean" with respect to unwanted toner deposition. Again, much of the structure of the apparatus can be as previously described and such portions are indicated by designators corresponding to those of FIGS. 1 and 2.

There are significant differences between apparatus 30 and previously-described embodiments which provide additional capabilities e.g., in regard to reproducing color originals or black-and-white reproductions. In this regard an array 31 of color filters e.g. including red, green and blue filters, is mounted along the optical path of exposure station 13. The array 31 is indexable by shaft 32 to selectively position each particular color filter in the optical path during the successive color-separation exposures of continuous-tone portions C of a color original $O_1$. Also in the apparatus 30 embodiment, the development means 14 includes discrete magnetic brush devices 14-1, 14-2, 14-3, 14-4, which are operable, in response to signals from logic and control unit 35, to selectively apply different colors of toner (e.g. cyan, magenta, yellow and black toner) to different photoconductor image sectors. The functioning of these additional devices in cooperation with the other structure of electrophotographic apparatus 30 will be easily understood by considering the following operational descriptions of its different modes.

To commence operation of a color copy run, component originals $O_1$ and $O_2$ are prepared and positioned at predetermined positions respectively on platens 16 and 26. In the illustrated embodiment, component original $O_1$ comprises a plurality of color continuous-tone information areas C (e.g. color prints) mounted on a light-transmissive support which forms background areas $B_1$. The component original $O_2$ for the FIG. 3 embodiment comprises a light-reflective (e.g. white) background $B_2$ with black mask areas M located in register with areas C of component original $O_1$ and with high-contrast, line-type information LT (e.g. black alphanumeric information) located in adjacent areas on the white support. Index or positioning means, e.g. guide rails 36, 37, are provided to assure proper relative location of the component originals and thus proper register of their light images at exposure stations $E_1$ and $E_2$. With the originals $O_1$ and $O_2$ thus prepared and positioned, the operator inputs control data to logic and control unit 35, e.g. by a keyboard (not shown). Such data can include: (1) the desired operational mode (color or black-and-white), (2) desired number of reproductions and (3) special exposure level information regarding the respective color-separation exposures of composite original $O_1$. With regard to the last-mentioned input data, the operator often will perform pre-runs of the color-separation exposures at varying levels to determine optimum exposure levels for the particular pictorial information involved. Logic and control unit 35 preferably contains memory to store selected exposure levels for each respective color-separation exposure.

When the above data is input, a "run" command is actuated by the operator, and the photoconductor belt 11 moves successive photoconductor image sectors thereof past primary charger 12 and onto exposure zone $E_1$. Position of the photoconductor image sectors is detected by a sensor, e.g. a detector D of perforations in the photoconductor, and a position signal is input to unit 35. Logic and control unit 35 effects control of successive red, green and blue color exposures onto successive photoconductor sectors. For example, such control from unit 35 can include synchronization of: (1) the indexing of filter array 31, (2) energization of power source $P_1$ at the desired level(s) and (3) energization of source $P_2$ to actuate background clean-up. The three photoconductor image sectors, thus exposed, respectively comprise screened, continuous-tone red, green and blue color-separation electrostatic images corresponding to portions C of the original $O_1$ and background portions discharged by source 18 to a level below the development level of apparatus 30 (e.g. below the bias level applied to the brushes of stations 14 by means not shown). As the sector bearing the red color-separation electrostatic image moves over magnetic brush 14-1, the brush is activated by unit 35 to apply cyan toner in accordance with the electrostatic image. Similarly brushes 14-2 and 14-3 are activated to apply magenta and yellow toner respectively to the subsequent green and blue electrostatic color-separation images on successive sectors of the photoconductor.

As a fourth primary-charged sector of the photoconductor belt 11 passes zone $E_1$, a panchromatic light exposure of selected tone-scale is effected by sources 17, without the activation of source 18. It may be preferred to filter this exposure, e.g. with another element of array 31, to achieve a more panchromatic system response for this exposure. At this stage, the electrostatic pattern on the fourth photoconductor image sector includes a screened, continuous-tone latent image pattern of the pictorial areas C and uniform primary charge on other areas corresponding to background $B_1$. The fourth sector moves next to exposure zone $E_2$, and, in proper timed relation with movement of belt 11, unit 35 activates sources 27 to effect a high-contrast exposure of component original $O_2$, in register with the image of component original $O_1$, onto the fourth sector. The electrostatic image on the fourth sector leaving zone $E_2$ thus comprises (1) the continuous-tone electrostatic image component exposed at zone $E_1$ (and undisturbed by the zone $E_2$ exposure because of mask portions M on original $O_2$), (2) the high-contrast, unscreened, alphanumeric electrostatic patterns corresponding to areas LT of composite original $O_2$ and (3) the clean background portions discharged below the development level. The fourth sector subsequently is developed with black toner by magnetic brush 14-4. It will be appreciated that logic and control unit 35 can be constructed to effect the above-described exposures of the four photoconductor image sectors in any desired sequence. Also, it will be appreciated that logic and control can effect exposures so that the line information is in a color(s) other than black. For example, cyan line information can be provided by omitting the source 18 illumination and providing source 23 illumination to the red filter exposed image sector rather than the neutral density exposed sector. Of course the apparatus 30 can employ less than four colors, if desired.

After exposure and development and in proper timed relation with movement of the photoconductor image sectors to transfer station 15, unit 35 signals actuation for feeding a copy sheet S to the transfer roller. Successive cyan, magenta, yellow and black toner images are then transferred to the copy sheet, in register, by the first, second, third and fourth image sectors of the photoconductor 11. Unit 35 then signals pick-off of the copy sheet by detack device 39, and copy sheet S is fed through fixing device F to a receiver bin. It will be appreciated that the successive reproductions of the composite original can be made in a continuous mode by repeating the above-described operation as the belt recirculates. Appropriate photoconductor cleaning and rejuvenation (known in the art) can be provided along the return path from station 15 to station 12.

Apparatus 30 also can be operated in a black-and-white copy mode. In such operation, appropriate control information is input to unit 35, e.g to select the black-and-white mode, the number of copies desired and any exposure level information for sources 17. Start of the copy run is commanded and control unit 35 effects repeated cycles of charge exposure and development as described above with respect to the fourth (black toner) sector on successive photoconductor image sectors. Copy sheet feed in this mode is activated for each photoconductor image sector, in contrast to the color mode where four toner images are transferred between each copy sheet detack and replacement cycle.

Figure 4:
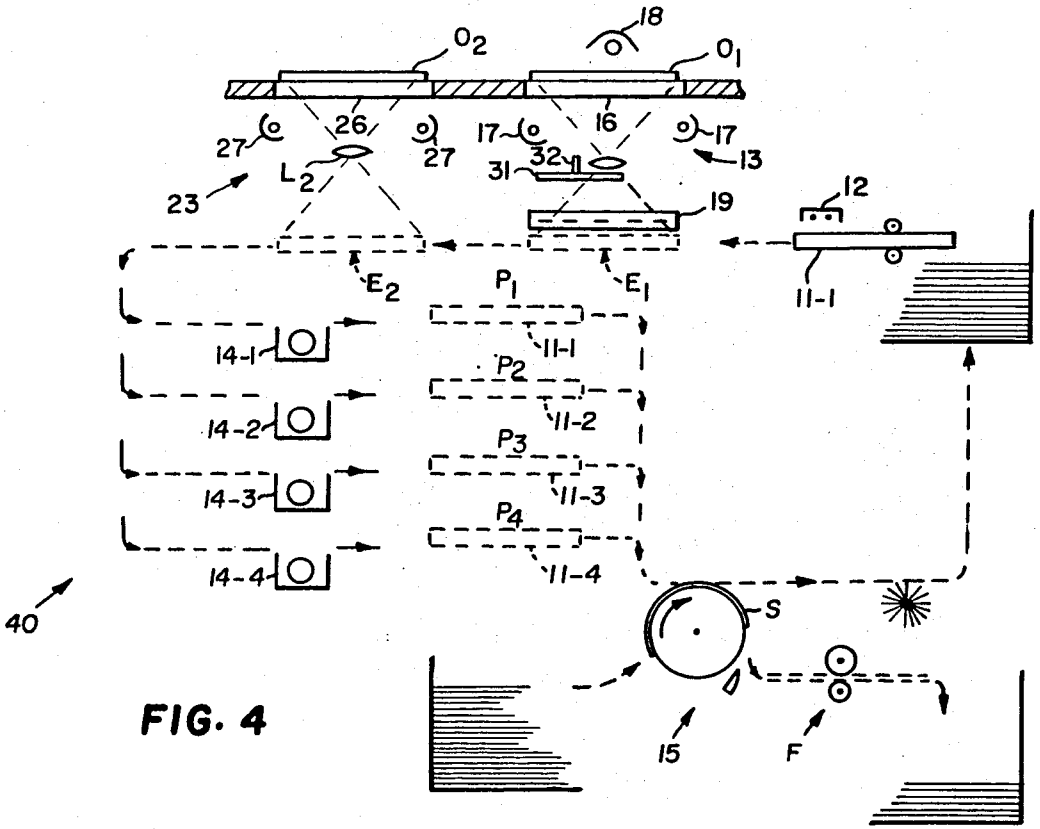
FIG. 4 is a schematic side view of yet another embodiment of electrophotographic apparatus for practice of the present invention.

FIG. 4 discloses another embodiment of electrophotographic apparatus 40 in accord with the present invention. Apparatus 40 is similar in functional capabilities to the FIG. 3 apparatus, and again, corresponding structural features are indicated with corresponding designators. The apparatus 40 differs from the FIG. 3 embodiment primarily with respect to the construction of the photoconductor image sectors and the operative path of the apparatus. Specifically, the photoconductor image sectors of apparatus 40 are in discrete sheet form and have separate paths within the development portion of the apparatus.

In operation in a color copy mode, originals $O_1$ and $O_2$ are prepared as described with respect to FIG. 3 and placed in register on platens 16 and 26. Appropriate control signals are input to a control and logic unit (not shown) and a start command is actuated. A first sheet sector 11-1 then is fed from a supply, primary-charged and exposed by device 13 via a red filter to original $O_1$ at zone $E_1$ (in the same manner described with respect to the first photoconductor image sector of the belt 11 of apparatus 30). The sheet 11-1 next is moved past exposure station 23 (without an exposure actuation), is developed by brush 14-1 with cyan toner and is moved to hold position $P_1$. Subsequently green and blue color-separation images are exposed on sheets 11-2 and 11-3 and the resulting electrostatic images are developed by magnetic brushes 14-2 and 14-3 and forwarded to hold positions $P_2$ and $P_3$. A sheet 11-4 is then primary-charged, exposed at station 13 (by source 17 only) and at station 23 by source 27, all in a manner like that described above regarding the fourth sector of apparatus 30. The composite image on sheet 11-4 is developed with black toner and sheet 11-4 is moved to position $P_4$. From this stage of the operation, the sheets can be forwarded to station 15 in any desired order for transfer of toner to a copy sheet S. As was the case with the FIG. 3 embodiment, apparatus 40 can be operated in a black only mode by successively repeating the sheet 11-4 sequence coordinated with successive copy sheet feed for each exposure sequence.

The invention has been described in detail with particular reference to preferred embodiments thereof, but it will be understood that variations and modifications can be effected within the spirit and scope of the invention.

For example, for certain applications it may be desirable to provide apparatus like that shown in FIGS. 3 or 4 but without source 18. In such embodiments each frame or sheet can be subjected to the exposures from stations 13 and 23 to achieve the desirable effects of continuous tone exposure levels tailored for good tone scale and retained highlight detail and high contrast background (with or without included line detail).

What is claimed is:

1. A method for electrophotographically producing copy having continuous-tone image area(s) of good tone-scale and bordering back-ground area(s) that are clean from unwanted develop-ment, said method comprising:

(a) electrostatically charging a photoconductor image sector to a primary charge level;

(b) reflection exposing the photoconductor sector in a predeterminedly registered relation to an original that comprises a light-reflective continuous-tone image area and bordering background area which is light-transmissive, such reflection exposure being at imaging levels adapted to optimize the tone-scale of the resulting latent electrostatic image;

(c) transmission exposing the photoconductor sector to the background area of said original, in said registered relation, at an exposure level higher than said imaging levels; and (d) developing the photoconductor sector so that its continuous-tone image portion has good tone-scale and its background portion is substantially clean from unwanted development.

2. The invention defined in claim 1 wherein both the reflection and transmission exposures of said photoconductor sector are via a proximately-spaced half-tone screen and the level of such transmission exposure is sufficient to discharge, below development level, the screen image on transmission-exposed photoconductor portions.

3. A method for producing an electrophotographic image having a continuous-tone information area and an adjacent background area, said method comprising:

(a) registering for exposure an original having a light-reflective, continuous-tone information area and adjacent, light-transmissive background area;

(b) uniformly electrostatically charging a photoconductor image sector to a primary charge level;

(c) reflection exposing the continuous-tone area of the registered original onto its counterpart area of the photoconductor sector at imaging exposure levels which form an electrostatic image with good tone-scale and highlight detail;

(d) transmission exposing the light-transmissive original area onto its counterpart area of the photoconductor sector at an exposure level which discharges such counterpart photoconductor area to a background charge level below the minimum density charge levels of the continuous-tone electrostatic image; and (e) electrographically developing the exposed photoconductor sector in the presence of a predetermined electrical bias selected, relative to such image and background charge levels, to provide good tone-scale and highlight reproduction of continuous-tone image and background area which is clean from unwanted developer.

4. Method of producing a toner image of light-reflective continuous-tone information and associated light-transmissive background using an electrostatically charged photoconductive member comprising:

illuminating the continuous-tone information and background to produce a reflected light image of the continuous-tone information and a transmitted light image of the background;

exposing the photoconductive member to the light images in register to form an electrostatic image on the member, the level of exposure of the photoconductive member to the image of the background being higher than the minimum density level of exposure of the member to the image of the continuous-tone information; and developing the electrostatic image on the member to produce a toner image having continuous-tone information and substantially clean background.

5. A method for producing an electrophotographic composite image having continuous-tone image areas of good tone-scale and line-type information areas with high contrast, said method comprising:

(a) uniformly electrostatically charging a photoconductor image sector;

(b) reflection exposing a registered first-component-original, which comprises a light-reflective, continuous-tone, image area and bordering non-reflective background area, through a half-tone screen and onto said charged photoconductor sector, such sector exposure being at imaging exposure levels selected to provide good tone-scale reproduction;

(c) exposing a registered second-component-original, which comprises a mask-area located in a region corresponding to the continuous-tone image area of said first component-original and a line-type information area in a region corresponding to the background area of said first component-original, onto said photoconductor sector at a high-contrast exposure level, said exposures being registered to form a composite latent electrostatic image on said photoconductor sector; and (d) developing the composite latent electrostatic image on such photoconductor sector.

6. A method for producing a composite electrophotographic image having a continuous-tone, multicolor image area(s) with good tone-scale, background area(s) which are substantially clean from unwanted development and line-type information area(s) of high contrast, said method comprising:

(a) uniformly electrostatically charging first, second, third and fourth photoconductor image frames to a predetermined primary charge level;

(b) reflection exposing a first-component-original, which comprises a light-reflective, continuous-tone, multicolor image area(s) and bordering, light-transmissive background area, onto three of said charged image frames, respectively via different color filters, such reflection exposures of the image frames being through a half-tone screen and at exposure levels which optimize tone-scale of the resulting electrostatic images;

(c) in register respectively with said reflection exposures of said three frames, transmission exposing said first-component-original onto each of said three frames at an exposure level which discharges the respective frame background areas below the minimum density charge level of the continuous-tone electrostatic image portions of said three frames;

(d) reflection exposing the other of said frames to said first-component-original through a half-tone screen at exposure levels which optimizes tone-scale of the resulting electrostatic image;

(e) exposing said other of said frames, at an exposure level optimized for high-contrast reproduction, to the light image of a second-component-original that comprises light masking area(s) located in register with said continuous-tone area(s) of said first-component-original and line-type information areas at locations not in register with said continuous-tone areas;

(f) developing said three frames respectively with different-color toners complementary to their respective color filter exposure and developing said other frame with black toner; and (g) transferring the developed toner images from respective photoconductor image frames in register onto a copy sheet.

7. A method for producing a composite electrophotographic image having a continuous-tone, multicolor image area(s) with good tone-scale, background area(s) which are substantially clean from unwanted development and line-type information area(s) of high contrast, said method comprising:

(a) electrostatically charging at least first and second photoconductor image frames to a predetermined primary charge level;

(b) reflection exposing a first-component-original, which comprises a light-reflective, continuous-tone, multicolor image area(s) and bordering, light-transmissive background area, onto one of said charged image frames, respectively via a color filter, such reflection exposure of the image frame being through a half-tone screen and at exposure levels which optimize tone-scale of the resulting electrostatic image;

(c) in register respectively with said reflection exposure of said one frame, transmission exposing said first-component-original onto said one frame at an exposure level which discharges the respective frame background areas below the minimum development density charge level of the continuous-tone electrostatic image portion of said one frame;

(d) reflection exposing another of said photoconductor frames to said first-component-original through a half-tone screen at exposure levels which optimize tone-scale of the resulting electrostatic image;

(e) exposing said another of said frames, at an exposure level optimized for high-contrast reproduction, to the light image of a second-component-original that comprises a light masking area(s) located in register with said continuous-tone area(s) of said first component-original and a line-type information area(s) at a location(s) not in register with said continuous-tone area(s);

(f) developing said frames respectively with different-color toners; and (g) transferring the developed toner images from respective photoconductor image frames in register onto a copy sheet.

8. In electrophotographic apparatus having platen means which supports and registers an original at an illumination zone and means for imaging an original at the illumination zone onto the exposure zone for the primary-charged photoconductor image sectors of said apparatus, an illumination system adapted for improved image reproduction by cooperation with originals that have light-reflective continuous-tone image areas and bordering, light-transmissive background areas, said illumination system comprising:

(a) first exposure means, including a first illumination source located on the opposite side of said platen means from said exposure zone, for effecting, through transmissive portions of such original, a relatively higher level photoconductor exposure which discharges portions of a primary-charged sector so exposed below a predetermined development level; and (b) second exposure means, including a second illumination source located between said platen means and said exposure zone, for effecting a relatively lower level photoconductor exposures with light reflected from such original's continuous-tone area(s), said second exposure means being selectively adjustable for varying the image tone-scale of photoconductor portions discharged thereby.

9. In apparatus for electrophotographically reproducing continuous-tone information and line information by forming electrostatic images on a primary-charged photoconductive member and developing such images, an improved electrostatic image forming means comprising:

first illumination means for effecting a reflected light exposure of such continuous-tone information with exposure levels selected for tone-scale reproduction;

second illumination means for effecting a transmitted light exposure of such line-information with a maximum exposure level substantially higher than the maximum exposure level of said reflected light pattern; and means for imaging the reflected light pattern and the transmitted light pattern, in register, on the photoconductor member.

10. In electrophotographic apparatus of the type having an operative path along which a photoconductor image sector is moved past apparatus charging, exposing and developing means, the improvement wherein said exposing means comprises:

(a) a first exposing device including a first platen means for registering a first component-original in a predetermined position, means for illuminating a first component-original which is registered at said first platen means, lens means for imaging the illuminated first component-original onto a first exposure zone located along said operative path and a half-tone screen located in the optical path of said lens means and proximate said first exposure zone, said first exposure device being constructed to effect exposure of a photoconductor sector at one of a plurality of exposure levels selectable to optimize tone-scale reproduction of continuous-tone images; and (b) a second exposing device including a second platen means for registering a second component-original in a predetermined position, means for illuminating a second component-original which is registered at said second platen means and lens means for imaging the illuminated second component-original onto a second exposure zone located along said operative path at a position distinct from said first exposure zone, said second exposure device being constructed to effect exposure of a photoconductor sector at an exposure level especially adapted for high-contrast reproduction of line-type images.

11. Electrophotographic imaging apparatus comprising:

(a) first, second, third and fourth photoconductor image sectors movable along an operative path of said apparatus;

(b) means, located along said path, for forming an electrostatic primary charge on photoconductor image sectors moving therepast;

(c) first support means for accurately positioning a first component-original in a first location which is registered relative to said operative path;

(d) first exposing means, operative at a first exposure zone along said path: (i) for exposing half-tone-screened, red, green, and blue color-separation images of a first-component-original that is positioned by said first support means, respectively onto three of said primary-charged photoconductor image sectors and (ii) for exposing a half-tone-screened, generally-panchromatic image of such first-component-original onto the other of said primary-charged photoconductor image sectors;

(e) second support means for accurately positioning a second-component-original in a second location which is registered relative to said first location and said operative path;

(f) second exposing means, operative at a second exposure zone along said path, for exposing said other photoconductor sector to the unscreened light image of a second-component-original that is positioned by said second support means;

(g) means for synchronizing said first and said second exposing means and the movement of said sectors at said first and second exposure zones so that said exposing by said second exposing means is in predetermined register with said exposure by said first exposing means; and (h) means for developing the red, green and blue exposed image sectors respectively with cyan, magenta and yellow toner and for developing said other image sector with black toner.

12. The invention defined in claim 11 wherein said first exposing means includes (1) means for reflection exposing the photoconductor sectors, at exposure levels that are optimized for tone-scale reproduction, to reflective continuous-tone portions of a first component-original at said first support means, (2) means for transmission exposing the photoconductor sectors, via transparent portions of an original at said first support means, at an exposure level that discharges corresponding photoconductor portions below a predetermined development level and (3) control means for (i) activating both said reflection and transmission exposing means with respect to such red, blue and green image exposured sectors and (ii) activating only said reflection exposing means with respect to such panchromatic image exposured sector.

13. The invention defined in claim 12 wherein said second exposing means includes means for exposing the other photoconductor image sector to the second component-original at an exposure level adapted for high-contrast reproduction of line-type information.

14. The invention defined in claim 12 wherein said reflection exposing means of said first exposing means is selectively adjustable to vary the levels of its exposure.

15. The invention defined in claim 11 wherein said first exposing means includes (1) means for imagewise exposing the photoconductor sectors, at exposure levels that are optimized for tone-scale reproduction, to continuous-tone portions of a first-component-original at said first support means, (2) means for background exposing other portions of the photoconductor sectors, which border the continuous-tone portions, at an exposure level that discharges such other portions below a predetermined development level and (3) control means for (i) activating both said imagewise and background exposing means with respect to said three photoconductor sectors and (ii) activating only said imagewise exposing means with respect to said other photoconductor sector exposure.

16. Electrophotographic imaging apparatus comprising:

(a) a plurality of photoconductor image sectors movable along an operative path of said apparatus;

(b) means, located along said path, for forming an electrostatic primary charge on photoconductor image sectors moving therepast;

(c) first support means for accurately positioning a first-component-original in a first location which is registered relative to said operative path;

(d) first exposing means, operative at a first exposure zone along said path for exposing half-tone-screened, different spectral content light images of a first-component-original that is positioned by said first support means, respectively onto different ones of said primary-charged photoconductor image sectors;

(e) second support means for accurately positioning a second-component-original in a second location which is registered relative to said first location and said operative path;

(f) second exposing means, operative at a second exposure zone along said path, for exposing at least one of said photoconductor sector to the unscreened light image of a second-component-original that is positioned by said second support means;

(g) means for synchronizing said first and said second exposing means and the movement of said photoconductor sectors at said first and second exposure zones so that said exposure by said second exposing means is in predetermined register with said exposure by said first exposing means;

(h) means for developing the exposed photoconductor image sectors respectively with different color toners; and (i) means for transferring said developed toner images in register to a copy sheet.

17. The invention defined in claim 16 wherein said first exposing means includes (1) means for reflection exposing the photoconductor sectors, at exposure levels that are optimized for tone-scale reproduction, to reflective continuous-tone portions of a first-component-original at said first support means, (2) means for transmission exposing the photoconductor sectors, via transparent portions of an original at said first support means, at an exposure level that discharges corresponding photoconductor portions below a predetermined development level and (3) control means for (i) activating both said reflection and transmission exposing means to at least one of said sectors and (ii) activating only said reflection exposing means to at least another different one of said sectors.

18. The invention defined in claim 17 wherein said second means for exposing includes means for exposing said another photoconductor image sector to the second-component-original at an exposure level adapted for high-contrast reproduction of line-type information.

19. The invention defined in claim 17 wherein said reflection exposing means of said first exposing means is selectively adjustable to vary the levels of its exposure.

20. The invention defined in claim 16 wherein said first exposing means includes (1) means for imagewise exposing the photoconductor sectors, at exposure levels that are optimized for tone-scale reproduction, to continuous-tone portions of a first-component-original at said first support means, (2) means for background exposing other portions of the photoconductor sectors, which border the continuous-tone exposure, at an exposure level that discharges such other portions below a predetermined development level and (3) control means for (i) activating both said imagewise and background exposing means with respect to one of said photoconductor sectors and (ii) activating only said imagewise exposing means with respect to another of said photoconductor sectors.

21. A method for electrophotographically producing a print having continuous-tone image areas and adjacent developer-free background areas, said method comprising the steps of:

(a) preparing a working original by disposing a continuous-tone image on a transparent support, said continuous-tone image having regions of varying reflectivity and being generally nontransparent;

(b) uniformly charging a photoconductor;

(c) illuminating the working original from one side to imagewise expose the photoconductor with only that light reflected from the continuous-tone image regions of the working original, thereby forming a latent charge image on the photoconductor; and (d) illuminating the working original from the opposite side to expose the photoconductor to light passing through the transparent regions of the working original, the intensity of such illumination being sufficient to discharge the photoconductor to a level less than the most-discharged portion of the latent charge image.

* * * * *